US011753234B2

(12) United States Patent
Ong

(10) Patent No.: US 11,753,234 B2
(45) Date of Patent: Sep. 12, 2023

(54) FILLABLE AEROSOL CONTAINER

(71) Applicant: Orientus Industry Sdn Bhd, Johor Bahru (MY)

(72) Inventor: Yoke En Ong, Skudai (MY)

(73) Assignee: Orientus Industry Sdn Bhd, Johor Bahru (MY)

( * ) Notice: Subject to any disclaimer, the term of this patent is extended or adjusted under 35 U.S.C. 154(b) by 0 days.

(21) Appl. No.: 17/772,702

(22) PCT Filed: Jan. 10, 2020

(86) PCT No.: PCT/MY2020/050003
§ 371 (c)(1),
(2) Date: Apr. 28, 2022

(87) PCT Pub. No.: WO2021/107754
PCT Pub. Date: Jun. 3, 2021

(65) Prior Publication Data

US 2023/0002145 A1 Jan. 5, 2023

(30) Foreign Application Priority Data

Nov. 26, 2019 (MY) ..... PI 2019006940

(51) Int. Cl.
*B65D 83/66* (2006.01)
*B65D 83/32* (2006.01)
*B65D 83/42* (2006.01)

(52) U.S. Cl.
CPC ..... *B65D 83/666* (2013.01); *B65D 83/32* (2013.01); *B65D 83/425* (2013.01)

(58) Field of Classification Search
CPC .... B65D 83/666; B65D 83/32; B65D 83/425; B65D 83/42; B65D 47/103; B65D 83/0022
See application file for complete search history.

(56) References Cited

U.S. PATENT DOCUMENTS 2,630,942 A * 3/1953 Shaffer ..... A62C 13/003 222/323
2,976,897 A 3/1961 Beckworth
(Continued)

FOREIGN PATENT DOCUMENTS

CN 107380748 11/2017
FR 1250009 11/1960

OTHER PUBLICATIONS

International Search Report dated Mar. 25, 2020.
(Continued)

*Primary Examiner* — Vishal Pancholi
(74) *Attorney, Agent, or Firm* — Preston Smirman; SMIRMAN IP LAW, PLLC

(57) ABSTRACT

The present invention discloses an aerosol container (100) comprising a body (101) divided into a first chamber (10) and a second chamber (20) by a divider (102), in which the first chamber (10) is under atmospheric pressure and configured to receive a customisable content through an inlet (200) at the body (101) either or both during and after production of the aerosol container (100), and the second chamber (20) is under a pressurised environment and prefilled with a pressurised content; wherein the body (101) includes a mechanism (104) which, when activated, acts on the divider (102) so as to allow mixing of the customisable content and pressurised content to form a mixture to be dispensed from the body (101) through an outlet (300).

11 Claims, 6 Drawing Sheets

(56) References Cited

U.S. PATENT DOCUMENTS

| | | | |
|---|---|---|---|
| 3,630,415 | A | 12/1971 | Morane et al. |
| 3,648,899 | A | 3/1972 | Lukesch et al. |
| 3,718,165 | A | 2/1973 | Grothoff |
| 6,543,490 | B1 | 4/2003 | Owens |

OTHER PUBLICATIONS

Written Opinion of the International Searching Authority dated Mar. 25, 2020.
International Preliminary Report on Patentability dated Jul. 7, 2021.
English Abstract of FR 1250009.
English Abstract of CN 107380748.

* cited by examiner

FILLABLE AEROSOL CONTAINER

CROSS-REFERENCE TO RELATED APPLICATION

The instant application is a national phase of PCT International Application No. PCT/MY2020/050003 filed Jan. 10, 2020, and claims priority to Malaysian Patent Application Serial No. PI 2019006940 filed Nov. 26, 2019, the entire specifications of both of which are expressly incorporated herein by reference.

FIELD OF INVENTION

The present invention relates to a fillable aerosol container, and more particularly to an aerosol container that permits filling of a customisable content under atmospheric pressure during and/or after production of the aerosol container, in which the customisable content is mixed with a prefilled pressurised content contained within the aerosol container when the aerosol container is in use.

BACKGROUND OF THE INVENTION

An aerosol container is a dispensing system designed to turn a liquid product into a finely dispersed mist, by propelling the liquid product with a pressurised propellant fluid stored therein. One of the commonly known dispensing systems is prepared by tightly sealing the container upon receiving the liquid product, and providing the container with a highly pressurised gaseous propellant through a valve system. Another popular dispensing system that uses a liquefied gas as the propellant is prepared by providing the sealed container with the liquefied gas which remains in its liquid state as long as the pressure therein is maintained. When the pressure within the dispensing system is reduced by pressing a nozzle thereon, the liquefied gas propellant boils and causes particles therein to break free, such that a gas layer is formed on a top portion of the system to push the liquid product and the propellant out from the container via the nozzle. However, these dispensing systems are non-refillable, and the aerosol container has to be discarded when the liquid product cannot be dispersed due to the low pressure or the propellant content in the container.

A fillable aerosol container is improvised to solve the abovementioned problems, but it generally requires additional equipment, such as an air compressor, to increase or maintain the pressure therein. In addition, dispersing consistency of the mist is highly dependable on several factors, including chemical makeup of the liquid product and propellant, ratio of the liquid product to propellant, pressure of the propellant, etc., thus disabling users without prior knowledge on the used aerosol container to fill up the aerosol container. The currently available fillable aerosol container only receives the refilling of the propellant or pressurised content. Such fillable aerosol container has been disclosed in U.S. Pat. No. 3,718,165A, in which the refillable aerosol dispenser comprises a container for dispensing a mixture of liquid and a gaseous propellant. The container has an upper wall provided with a dispensing valve, and a bottom wall provided with a separate inlet valve, in which the separate inlet valve operates independently of the dispersing valve for admitting gaseous propellant into the container. However, the filling operation of this invention requires a separate aerosol can to inject the gaseous propellant into the container.

A custom colour mixing aerosol container is disclosed in a U.S. Pat. No. 6,543,490B1, in which the patent discloses a pre-charged aerosol container for dispensing paints that allows the user to custom mix colours in the container at a paint store or retail outlet to obtain a desired colour. Nevertheless, the filling operation requires a sophisticated apparatus to supply the colourant to the container, and needs a precaution to remove the colorant from its manifold and dip tube to prevent colour contamination. The aerosol container that is already filled with a propellant, solvent and base paint receives a desired colorant through an injection means of the apparatus into the pressurised aerosol container through a fluid discharge valve of the container.

Accordingly, it would be desirable to provide a fillable aerosol container having a body prefilled with a pressurised content and is capable of receiving a customisable content under atmospheric pressure either or both during and after production of the aerosol container with or without the assistance of additional apparatus. Such aerosol container solves the limitations of the abovementioned disclosed inventions.

SUMMARY OF INVENTION

The main objective of the invention is to provide an aerosol container configured with an arrangement for receiving a customisable content under atmospheric pressure, and permitting its mixing with a prefilled pressurised content, such that the composition, texture and colour of the customisable content can be decided prior to be being introduced into the aerosol container to suit a desired application and preference of a user. Such invention allows users to manipulate the content to be dispersed including adding, modifying, removing and replacing the customisable content. The aerosol container is provided with at least one chamber for receiving a content under atmospheric pressure, and thereby permits filling the container even without the application of any pressurising equipment at any time including either or both during and after production of the aerosol container. The invention provides an easy and convenient approach to promote homogenous mixing of the contents therein, such that the mixture to be discharged has better dispensing properties. Manual pouring or injection using an injector enables the aerosol container to be filled with the customisable content. By allowing the customisable content to be filled into the aerosol container under atmospheric pressure, safety of use of the aerosol container is enhanced.

In a first aspect of the invention there is provided an aerosol container comprising a body divided into a first chamber and a second chamber by a divider, in which the first chamber is under atmospheric pressure and configured to receive a customisable content through an inlet at the body either or both during and after production of the aerosol container, and the second chamber is under a pressurised environment and prefilled with a pressurised content; wherein the body includes a mechanism which, when activated, acts on the divider so as to allow mixing of the customisable content and pressurised content to form a mixture to be dispensed from the body through an outlet.

In this aspect of the invention, the divider can be in a form of an inner sleeve, whereby space within the inner sleeve is defined as the first chamber, and space between the inner sleeve and the body is defined as the second chamber.

In this aspect of the invention, the mechanism extends from an external portion of the body into an internal portion of the body for forming an aperture at the divider when the mechanism is activated through exerting a force on the external portion of the body to allow the mixing of the customisable content and pressurised content.

In this aspect of the invention, the mechanism comprises a stem that has at least one sharp distal end facing the divider such that when the mechanism is activated, the sharp distal end comes into contact with the divider and ruptures it.

In this aspect of the invention, the inlet comprises a valve assembly having a housing that accommodates a gasket and a spring-supported stem, and a cap connected to the housing and having a protrusion that projects towards the spring-supported stem.

In this aspect of the invention, the cap can be formed with an opening for receiving the customisable content.

In this aspect of the invention, the gasket fits around the spring-supported stem that blocks the customisable content from entering into or exiting from the first chamber when the valve assembly is in a non-actuated state.

In this aspect of the invention, the spring-supported stem can be dislocated from being fitted around the gasket when a force is applied thereon through the protrusion of the cap such that a gap is formed between the gasket and the spring-supported stem for allowing the customisable content entering from the opening of the cap to flow into first chamber when the valve assembly is in an actuated state.

In this aspect of the invention, the outlet enables dispensing of the pressurised content or the mixture when the body is held in a particular or any position.

In this aspect of the invention, the aerosol container further comprises a dip tube in the body that comprises one free end disposed within the body and another end connecting to the outlet for dispensing the pressurised content before the mixture is produced, or dispensing the mixture after the mixture is produced.

In this aspect of the invention, the inlet and the outlet share a same position on the body, and the mechanism is coupled to the inlet and the outlet and disposed in the first chamber.

One skilled in the art will readily appreciate that the present invention is well adapted to carry out the objects and obtain the ends and advantages mentioned, as well as those inherent therein. The embodiment described herein is not intended as limitations on the scope of the invention.

BRIEF DESCRIPTION OF THE DRAWINGS

For the purpose of facilitating an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

The invention will now be described in greater detail, by way of example, with reference to the drawings.

The present invention relates to an aerosol container which allows users to conveniently fill in a customisable content under atmospheric pressure for mixing with a prefilled content therein at any time either or both during and after production of the aerosol container. When the customisable content is filled into the aerosol container during production of the aerosol container, it is considered to be prefilled. However, the customisable content can also be filled into the aerosol container after production of the aerosol container to be ready for use by a user. The aerosol container which is also known as a dispensing system houses both the customisable content under atmospheric pressure and the prefilled content under pressurised environment in their respective chambers. The contents are mixable and dispensable for a desired application. The term 'customisable' used herein indicates that the customisable content can be added, removed, replaced or modified based on the preference of a user of the aerosol container. For example, but not by limitation, the customisable content, preferred to be liquid, is a colourant, a polymer, a lacquer or a water-based solvent, whereas the prefilled content can comprise a resin or hardener and is in the form of a colourant, a polymer, a lacquer or a water-based solvent.

Figure 1:
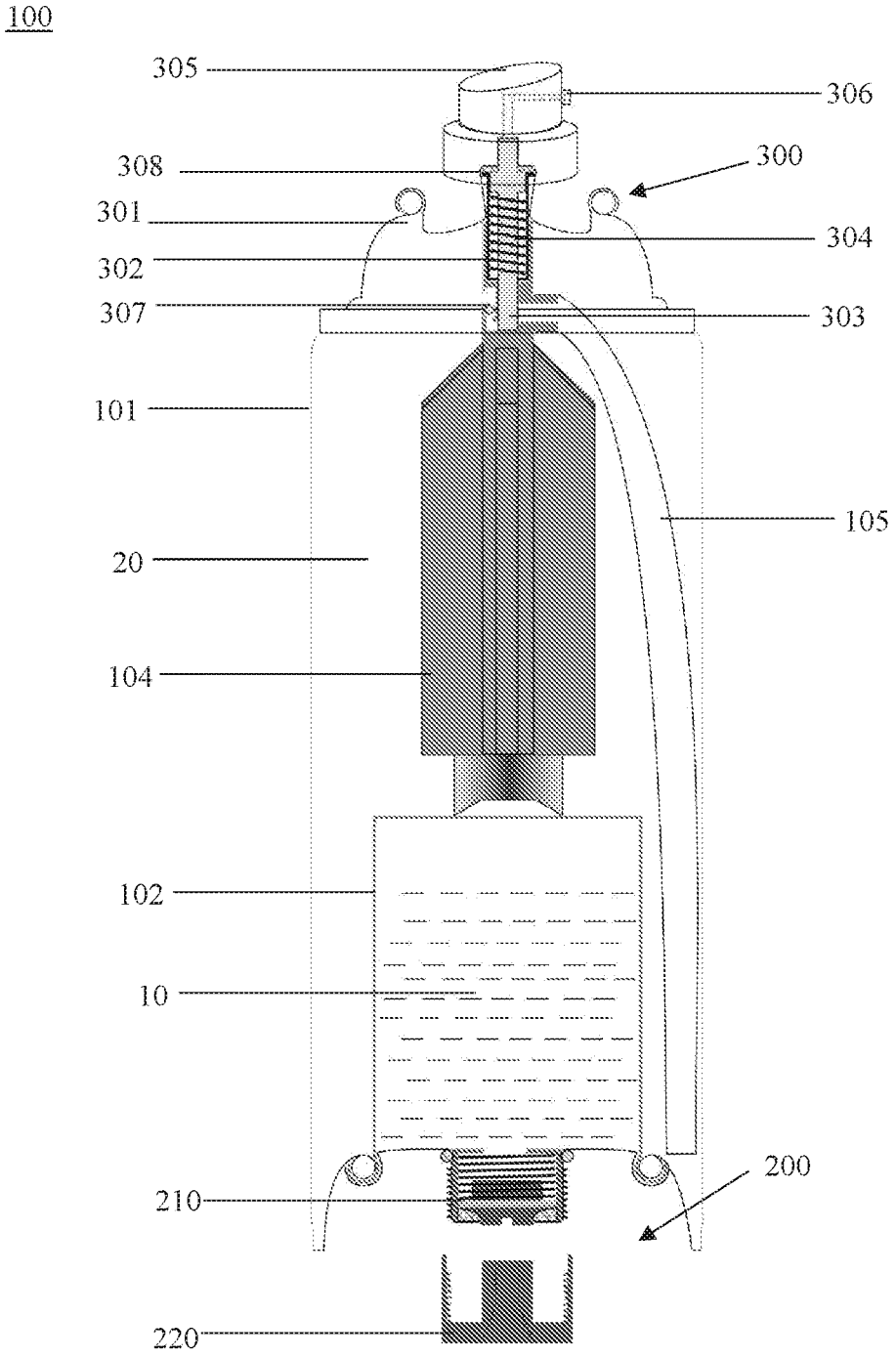
FIG. 1 is a schematic diagram illustrating a preferred embodiment of the aerosol container in the present invention.

FIG. 1 illustrates a preferred embodiment of the aerosol container 100. In this particular embodiment, the aerosol container 100 has a body 101 being divided into a first chamber 10 and a second chamber 20 by a divider 102. By way of example, but not by way of limitation, the divider 102 is in a form of a wall extending from one inner surface to another inner surface of the body 101, or an inner sleeve having a cylindrical casing with one end connected to an inner surface of the body 101. Preferably, at least one portion of the divider 102 is a rupturable diaphragm or membrane. In this particular embodiment, the first chamber 10 is defined by a space within the divider 102 configured for receiving the customisable content under atmospheric pressure through an inlet 200, and thus the first chamber 10 is in an atmospheric pressure environment. The second chamber 20 is defined by a space between the divider 102 and the body 101 configured to be prefilled with the pressurised content, and therefore the second chamber 20 is in a pressurised environment. The body 101 may be provided with a shape of, but not limited to, a cylinder, and is made up of, but not limited to, a metal or an alloy that can withstand a suitable amount of pressure.

The body 101 includes a mechanism 104 being a stem extending from an external portion of the can body 101 into an internal portion of the can body 101. Preferably, the stem comprises at least one sharp distal end facing and in proximity to the divider 102. When the mechanism 104 is activated through exerting a force onto the stem that is located at the external portion of the body 101, the stem comes into contact with the divider 102 and ruptures the divider 102 to form an aperture to allow the mixing of the customisable content and pressurised content to form the mixture. Optionally, the mechanism 104 can be activated to open one side of the divider 102 being the inner sleeve to form the aperture. The aperture may also be formed by detaching the divider 102 from at least one inner surface of the body 101 in which the divider 102 is adhered thereon by exerting a force thereon through the mechanism 104. The aperture enables a fluid communication between the chambers to form a mixture to be dispensed from the body 101 through an outlet 300.

As described herein, the term "fluid communication" refers to mixing the contents from the first chamber 10 and the second chamber 20. The content from either one or both the chambers may flow through the aperture to induce the mixing via diffusion. The fluid communication may also be facilitated by vigorously agitating the body 101. A ball bearing may be provided therein to facilitate the agitation.

Figure 2:
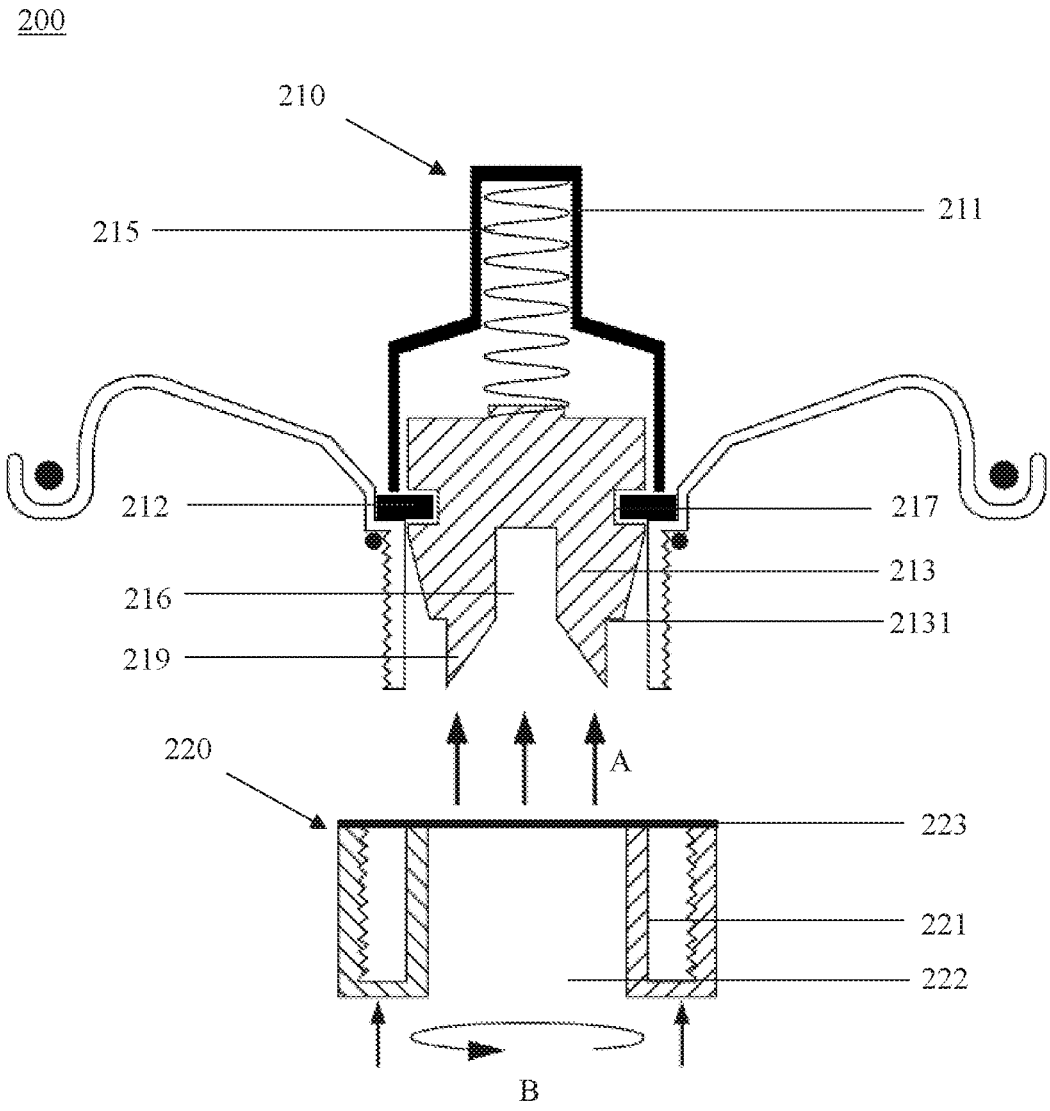
FIG. 2 shows the cap and the valve assembly that forms the inlet before the cap is fitted to the valve assembly.
Figure 3:
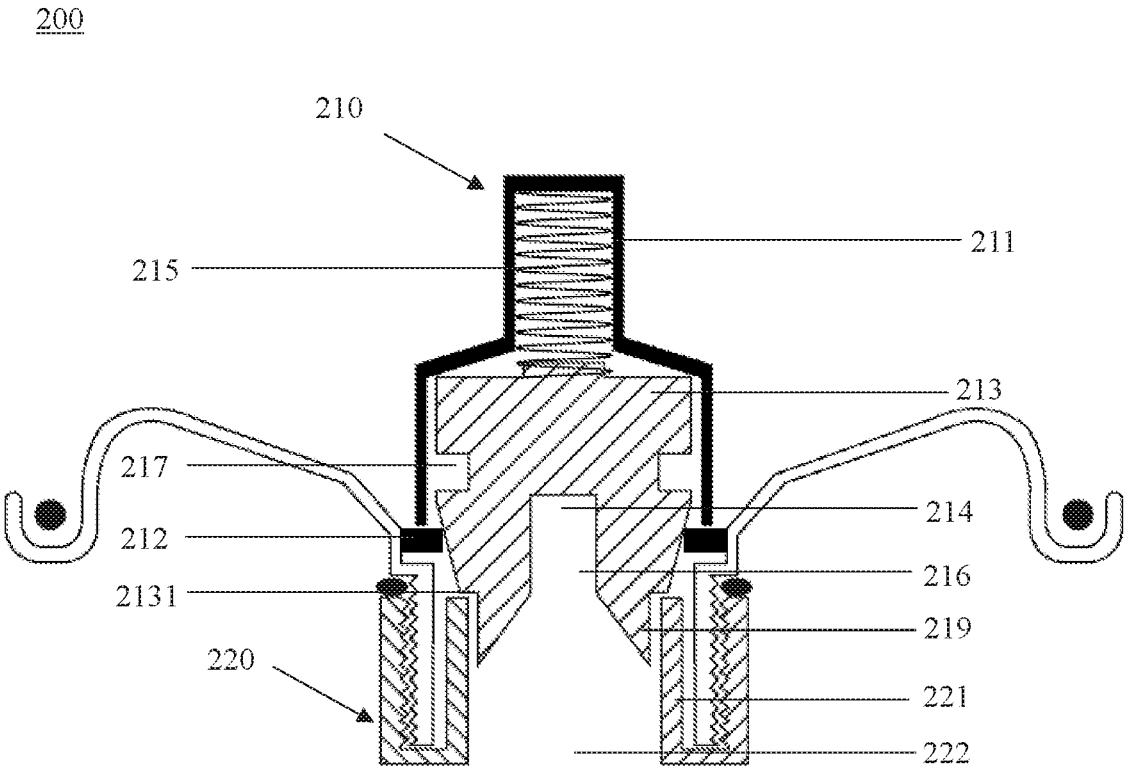
FIG. 3 shows the actuated state of the valve assembly when the cap is fitted around the housing of the valve assembly.
Figure 6:
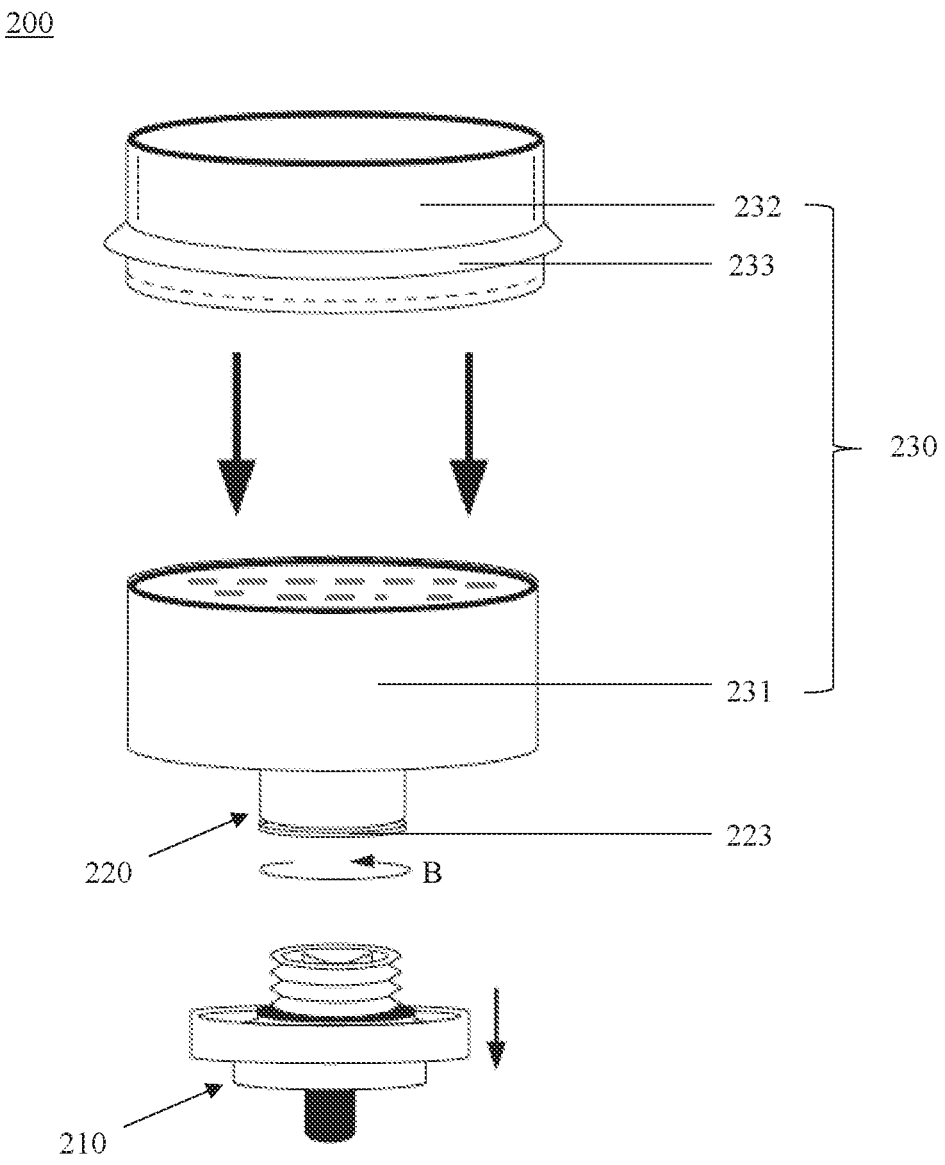
FIG. 6 shows an exemplary injector for introducing the customisable content into the aerosol container.

FIGS. 2 and 3 show a preferred embodiment of the inlet 200 that is formed by two main portions which are a valve assembly 210 and a cap 220. Particularly, the valve assembly 210 has a housing 211 that accommodates a gasket 212 and a spring-supported stem 213. The cap 220 is at least partially fitted around the housing 211. An external surface of the housing 211 is preferably form with threads that correspond to threads formed on an inner surface of the cap 220. The threads allow rotation of the cap 220 around the housing 211 as indicated by arrow B for adjusting position of the cap 220 to move closer towards or away from the body 101 when the cap 220 is engaged to the housing 211 of the valve assembly 210. A protrusion 221 is provided within the cap 220 and is projected towards the spring-supported stem 213. In the preferred embodiment of the invention shown in FIGS. 2 and 3, the protrusion 221 is positioned around the inner surface of the cap 220. The outer end of the spring-supporting stem 213 is formed with a recess 2131 that is reachable by the protrusion 221. An opening 222 is formed on the cap 220 for receiving the customisable content, in which the content can be introduced therein through a manual pouring or injection. The cap 220, especially the opening 222 can be structured to facilitate manual pouring of the customisable content, or connection with an apparatus such as an injector for the injection of the customisable content. In one exemplary embodiment, one end of the opening 222 is sealed with a membrane 223 rupturable when the cap 220 is fitted around the housing 211. The membrane 223 prevents the customisable content from leaking prior to the fitting. Another end of the opening 222 is fitted with an injector 230 comprising a vessel 231 containing the customisable content and a plunger 232 to facilitate the injection. The plunger 232 is further provided with a scrapper 233 to ensure an air-tight condition within the vessel 231 when filling the customisable content into the body 101. An exemplary injector 230 is shown in FIG. 6.

In one preferred embodiment, the housing 211 has an open end and another end connected to the first chamber 10. The open end has an inner circumference that is provided with the gasket 212. The gasket 212 is in a shape and dimension that correspond to the inner surface of the open end of the housing 211. The gasket 212 is formed with an orifice to allow the spring-supported stem 213 to extend therethrough. Thus, it is preferred that the gasket 212 is in an annular shape. Particularly, the spring-supported stem 213 has a spring 215 attached to an inner end of the stem 213 that is positioned adjacent to the first chamber 10. The stem 213 has an outer end that extends out of the gasket 212 and distal to the first chamber 10. A groove 216 is provided on the outer end of the stem 213 for forming a gap 214 between the gasket 212 and the groove 216 to allow entry or exit of the customisable content into the body 101 respectively. The outer end of the stem 213 is provided with a sharp end 219 for rupturing the membrane 223 on the cap 220.

The stem body in between the inner end and outer end of the spring-supported stem 213 has a diameter that corresponds to the diameter of the orifice of the gasket 212 and is larger than diameter of the outer end. The stem body is provided with a depression 217 that fits the gasket 212 for locking the valve assembly 210 to prevent entry or exit of the customisable content. When the valve assembly 210 is not actuated, the gasket 212 is fitted around the depression 217, such that the open end of the housing 211 is sealed to block the customisable content from entering or exiting the first chamber 10 through the housing 211. When the open end of the housing 211 is sealed, the valve assembly 210 is considered as being in a non-actuated state or a closed state.

Figure 5:
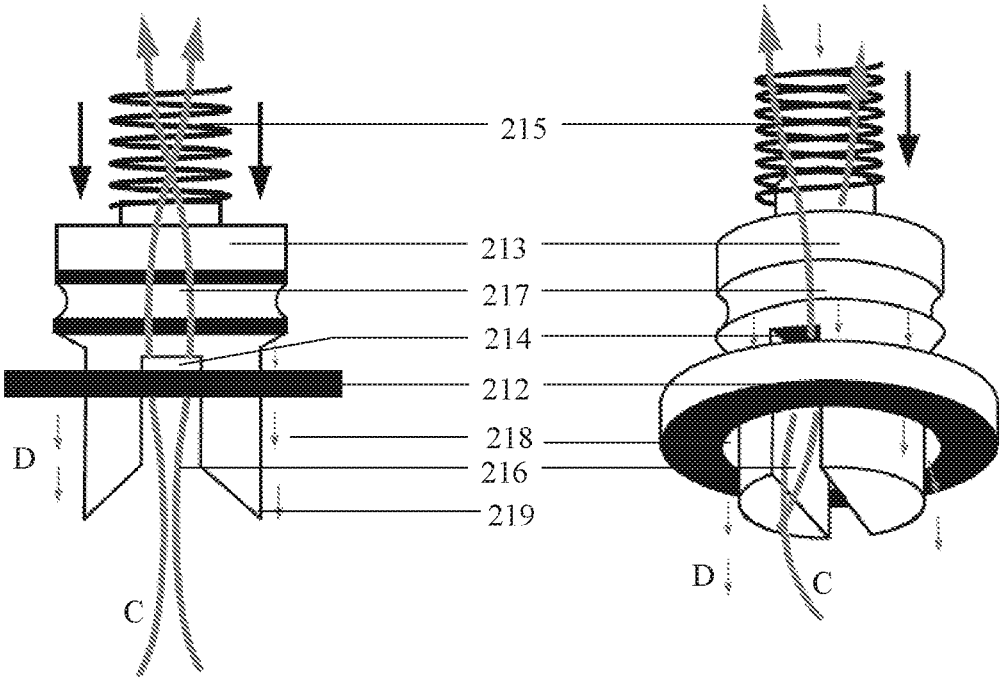
FIG. 5 shows a detailed diagram of the spring-supported stem being moved away from being fitted around by the gasket when the valve assembly is in an actuated state when a force is exerted onto the spring-supported stem to allow the customisable content to flow through the passageway.

On the other hand, when the open end of the housing 211 is not sealed, the valve assembly 210 is in an actuated state or an open state. This state is attainable by moving the stem body away from the orifice, such that the depression 217 moves towards the first chamber 10 and away from the gasket 212, and the groove 216 moves partially into the housing 211 to form the gap 214 between the gasket 212 and the groove 216. Furthermore, the outer end of the stem 213 has a smaller diameter which does not correspond to the diameter of the orifice is positioned within the orifice, when the stem body is dislocated from being fitted around by the orifice of the gasket 212. Such movement of the stem 213 is performed through actuating the valve assembly 210 by exerting a force onto the stem 213 that in turn compresses and shortens the spring 215 to move the stem 213 towards the first chamber 10. The movement also enables the outer end of the stem 213 to be positioned within the orifice. Such positioning of the outer end of the stem 213 enables the formation of the gap 214 and an air flow passage 218 between the outer end of the stem 213 and the groove 216. The air flow passage 218 enables air within the first chamber 10 to be released into the atmosphere. In one preferred embodiment, the sharp end 219 of the outer end of the stem 213 penetrates and ruptures the membrane 223 to enable the customisable content to enter from the opening 222 of the cap 220 and flow along a passageway that includes the opening 222 and the groove 216 within the inlet 200 as indicated by arrow C as shown in FIG. 5 to reach the first chamber 10. Meanwhile, the air flow passage 218 allows the air within the first chamber 10 to escape into the atmosphere in a direction as indicated by arrow D.

Figure 4:
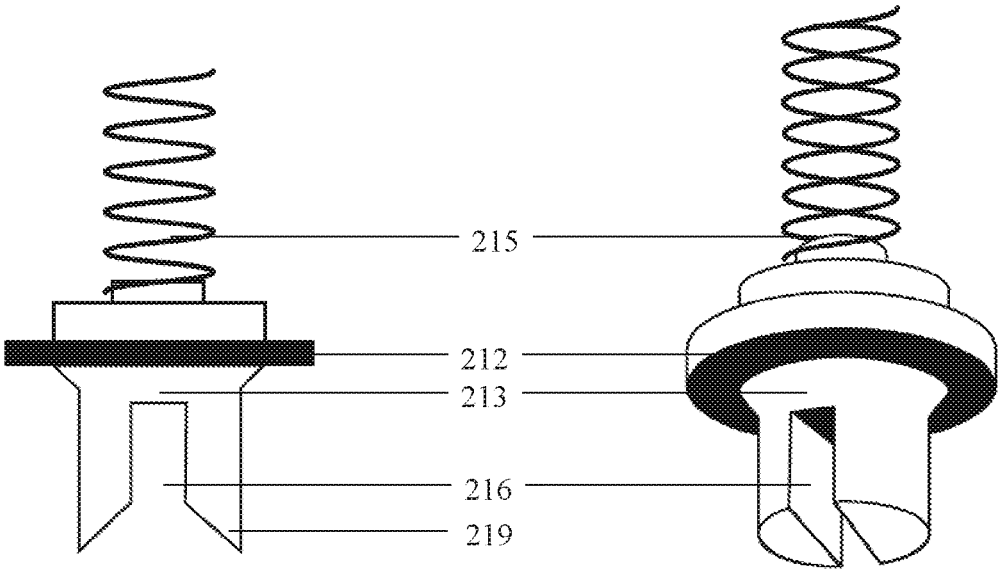
FIG. 4 shows a detailed diagram of the spring-supported stem being fitted around by the gasket when the valve assembly is in a non-actuated state.

Preferably, actuating of the valve assembly 210 can be done through applying a force to move the stem body away from the orifice of the gasket 212. The force can be either or both of a rotational force and a push force, in which the push force may include pressing, pushing, compressing, etc. In a preferred embodiment as shown in FIGS. 4 and 5, both the external surface of the housing 211 and the inner surface of the cap 220 are threaded to allow the cap 220 to be rotated around the external surface of the housing 211. When the cap 220 is rotated towards the body 101, the protrusion 221 therein contacts the recess 2131 at the outer end of the stem 213 and the rotational force translates to a push force to push the stem 213 towards the first chamber 10 as indicated by arrow A and B in FIG. 2, thereby causing the stem body to move closer to the first chamber 10 and the outer end of the stem 213 to be positioned within the orifice to expose the gap 214 for allowing entry of the customisable content. Besides that, the actuation of the valve assembly 210 allows replacement or removable of the customisable content contained within the first chamber 10 along the passageway. When the cap 220 is rotated away from the body 101, the protrusion 221 moves away from the recess 2131 at the outer end of the stem 213 and the push force is removed from the stem 213, allowing the spring 215 to return to its original length that brings the stem 213 back to be positioned within the orifice to seal the open end of the housing 211, thus closing the gap 214.

The outlet 300 extends from an external portion towards internal portion the body 101. The outlet 300 includes a valve fixture 301 affixed to the body 101 at which the valve housing 302 is mounted. A valve stem 303, a spring 304, and a gasket 308 are located within the valve housing 302. A button 305 having at least a nozzle 306 is attached to external end of the valve stem 303 to allow pressing of the button 305 for dispensing the mixture. A valve 307 is disposed at a position adjacent to internal end of the valve stem 303. Preferably, the valve 307 allows 360 degree opening for the mixture to be dispensed out of the body 101. Depending on the type of valve 307 used and the components within the outlet 300 that are involved in the dispensing process, the pressurised content or the mixture can be dispensed when the body 101 is held in a particular or any position. A dip tube 105 is provided in the aerosol container 100 that comprises one free end disposed within the body 101 and another end connecting to the outlet 300, in particular near to the valve 307 at the inner end of the valve stem 303 for dispensing the pressurised content before the mixture is produced, or dispensing the mixture after the mixture is produced. The dip tube 105 extends towards a bottom portion of the body 101 to ensure the content or mixture therein can be fully dispensed.

The outlet 300 and the mechanism 104 can be disposed at various positions on the aerosol container 100. In an exemplary embodiment, the inlet 200 and outlet 300 share a same position on the body 101, and the mechanism 104 is coupled to the inlet 200 and outlet 300 and disposed in the first chamber 10. In another exemplary embodiment, the inlet 200 and outlet 300 respectively dispose at a different position on the body 101, and the mechanism 104 either couples to the inlet 200 and being disposed in the first chamber 10, or couples to the outlet 300 and being disposed in the second chamber 20. In the preferred embodiment depicted in FIG. 1, the inlet 200 is positioned at one end of the aerosol container 100, whereas the outlet 300 is positioned at an opposite end of the aerosol container 100. The mechanism 104 is coupled to the outlet 300 such that when the button 305 is pressed to dispense the content within the body 10, the valve 307 of the outlet 300 is actuated at the same time as the activation of the mechanism 104 to form the aperture on the divider 102 for allowing mixing of the customisable content with the pressurised content. This embodiment requires one single force to be applied onto the button 305 for both rupturing of the divider 102 and dispensing of the mixture.

Advantageously, the aerosol container 100 of the present invention enables filling of a customisable content, such as a fluid, a liquid, or a molten composition, through a convenient approach without pre-pressurizing it. This feature widens the usability of an aerosol container 100 by allowing the user to decide on the composition, texture and colour of the customisable content, and enables the invention to be conveniently used for a coating or spraying application. In addition, the arrangement of the chambers, the divider and the mechanism in the aerosol container 100 is carefully tailored to enable homogenous mixing of the contents therein and improved dispensing properties of the mixture.

The present disclosure includes as contained in the appended claims, as well as that of the foregoing description. Although this invention has been described in its preferred form with a degree of particularly, it is understood that the present disclosure of the preferred form has been made only by way of example and that numerous changes in the details of construction and the combination and arrangements of parts may be resorted to without departing from the scope of the invention.

The invention claimed is:

1. An aerosol container, comprising:

a body divided into a first chamber and a second chamber by a divider, in which the first chamber is under atmospheric pressure and configured to receive a customisable content through an inlet at the body, and the second chamber is under a pressurised environment and prefilled with a pressurised content;

wherein the inlet is formed by a valve assembly having a housing that accommodates a spring-supported stem, and a cap connected to the housing with a protrusion that projects towards the spring-supported stem;

wherein the body includes a mechanism which, when activated, acts on the divider so as to allow mixing of the customisable content and pressurised content to form a mixture to be dispensed from the body through an outlet;

wherein the inlet is exposed at an external part of the body and configured to allow entering of the customisable content into the first chamber through manual pouring or by connection with an apparatus to supply the customisable content from the apparatus into the inlet, either or both during and after production of the aerosol container before mixing occurs.

2. The aerosol container according to claim 1, wherein the divider is in a form of an inner sleeve, whereby space within the inner sleeve is defined as the first chamber, and space between the inner sleeve and the body is defined as the second chamber.

3. The aerosol container according to claim 2, wherein the mechanism extends from an external portion of the body into an internal portion of the body for forming an aperture at the divider when the mechanism is activated through exerting a force on the external portion of the body to allow the mixing of the customisable content and pressurised content.

4. The aerosol container according to claim 3, wherein the mechanism comprises a stem that has at least one sharp distal end facing the divider such that when the mechanism is activated, the sharp distal end comes into contact with the divider and ruptures it.

5. The aerosol container according to claim 1, wherein the housing accommodates a gasket.

6. The aerosol container according to claim 5, wherein the cap is formed with an opening for receiving the customisable content.

7. The aerosol container according to claim 5, wherein the gasket fits around the spring-supported stem that blocks the customisable content from entering into or exiting from the first chamber when the valve assembly is in a non-actuated state.

8. The aerosol container according to claim 5, wherein the spring-supported stem is dislocated from being fitted around by the gasket when a force is applied thereon through the protrusion of the cap such that a gap is formed between the gasket and the spring-supported stem for allowing the customisable content entering from the opening of the cap to flow into first chamber when the valve assembly is in an actuated state.

9. The aerosol container according to claim 1, wherein the outlet enables dispensing of the pressurised content or the mixture when the body is held in a particular or any position.

10. The aerosol container according claim 1, further comprising a dip tube in the body that comprises one free end disposed within the body and another end connecting to the outlet for dispensing the pressurised content before the mixture is produced, or dispensing the mixture after the mixture is produced.

11. The aerosol container according to claim 1, wherein the inlet and the outlet share a same position on the body, and the mechanism is coupled to the inlet and the outlet and disposed in the first chamber.

* * * * *